United States Patent [19]

Nilsson

[11] Patent Number: 4,694,817

[45] Date of Patent: Sep. 22, 1987

[54] HEATING STOVE AND METHOD FOR THE COMBUSTION OF FUELS IN HEATING STOVES

[76] Inventor: Sture Nilsson, Blå Grind, S-599 00 Ödeshög, Sweden

[21] Appl. No.: 828,323

[22] PCT Filed: Apr. 1, 1985

[86] PCT No.: PCT/SE85/00149

§ 371 Date: Dec. 10, 1985

§ 102(e) Date: Dec. 10, 1985

[87] PCT Pub. No.: WO85/04464

PCT Pub. Date: Oct. 10, 1985

[30] Foreign Application Priority Data

Mar. 30, 1984 [SE] Sweden ..... 8401770

[51] Int. Cl.[4] ..... F24B 5/00

[52] U.S. Cl. ..... 126/76; 126/287; 126/74; 126/280; 126/69; 126/121

[58] Field of Search ..... 126/58, 65, 66, 67, 126/69, 73, 74, 75, 76, 77, 121, 280, 286, 287, 288, 289, 292

[56] References Cited

U.S. PATENT DOCUMENTS

| | | | |
|---|---|---|---|
| 4,102,318 | 7/1978 | Runquist | 126/76 X |
| 4,182,304 | 1/1980 | Mele | 126/76 |
| 4,320,738 | 3/1982 | Johnson | 126/77 |
| 4,337,753 | 7/1982 | McGinn | 126/287 |
| 4,341,198 | 7/1982 | Sullivan | 126/77 X |
| 4,380,228 | 4/1983 | Crowley | 126/76 |
| 4,494,525 | 1/1985 | Albertsen | 126/289 |

FOREIGN PATENT DOCUMENTS

| | | | |
|---|---|---|---|
| 215972 | 5/1923 | United Kingdom | 126/76 |
| 332843 | 7/1930 | United Kingdom | 126/287 |

*Primary Examiner*—Margaret A. Focarino
*Attorney, Agent, or Firm*—Howson and Howson

[57] ABSTRACT

In order to eliminate flue gases generated in combustion of fuels in heating stoves a heating stove (1) is designed with a duct (14) above the fireplace (5) and closeable by means of a damper (16), whereby the flue gases pass through the bed of embers generated during combustion. A hearth (6) for the bed of embers is designed with obliquely set flat surfaces (26) for attaining of a concentrated bed of embers. There is located in the combustion chamber (58) of the heating stove (1) below the hearth (6) an aperture (9), which communicates with flue ducts (11), which communicate in turn with a flue (20), which discharges the flue gases from the heating stove. By means of a filling hatch (15) access can be gained to the interior of the said duct (14) to fill the heating stove and its fireplace with fuel. By means of regulating devices (17), which are in connection with the damper (16) and at least one front hatch (3) displaying the heating stove (1), there is achieved a regulation of the damper that is controlled by the front hatch, whereby when the front hatch is opened then the damper is opened and when the front damper is closed then the damper is closed and shuts the said duct (14).

18 Claims, 11 Drawing Figures

HEATING STOVE AND METHOD FOR THE COMBUSTION OF FUELS IN HEATING STOVES

TECHNICAL FIELD

Figure 1:
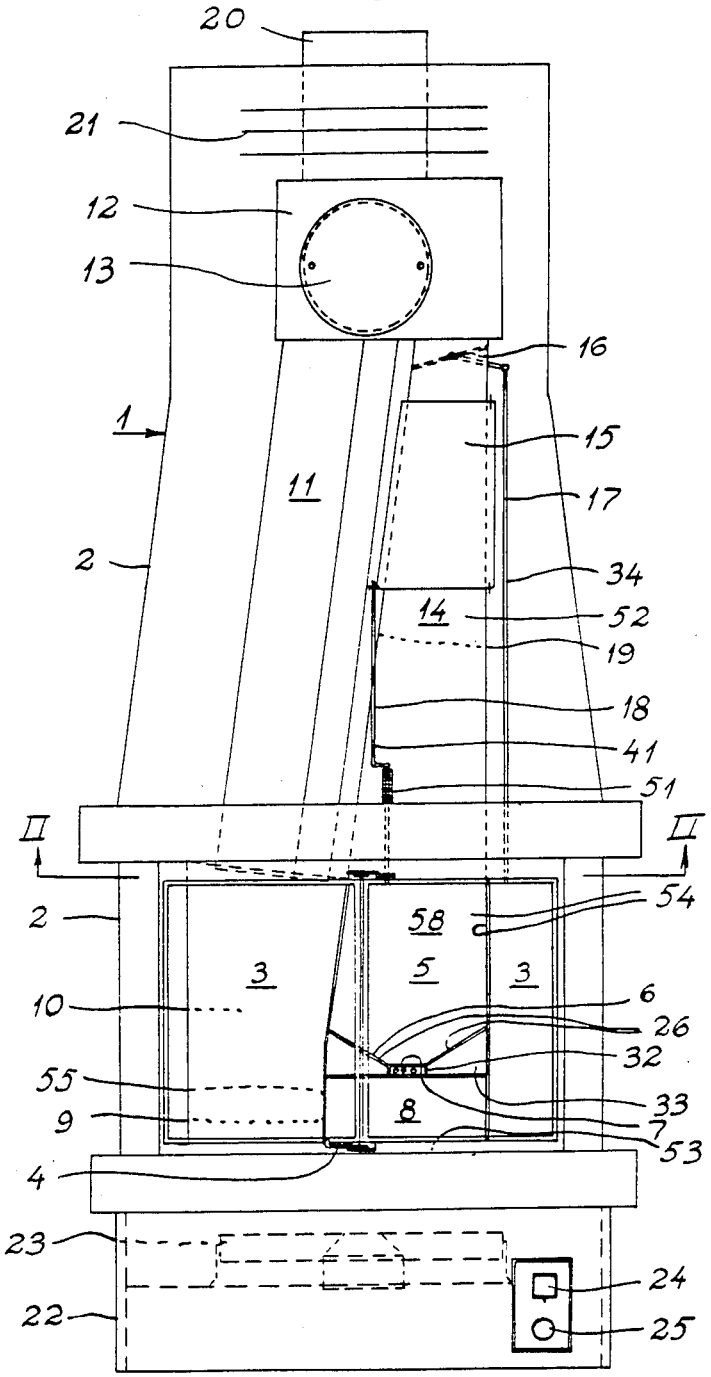

The present invention relates to a method for the combustion of fuels in heating stoves displaying at least one front hatch, whereby the heating stove displays a fireplace with a hearth and ducts that communicate with a flue or an exhaust pipe, whereby a first duct or equivalent is disposed for discharge of flue or exhaust gases or residues thereof to the said flue pipe, which is disposed for discharge of the said flue gases or equivalent from the heating stove.

BACKGROUND

There is a need for heating stoves, in which flue and other exhaust gases produced are eliminated or reduced to a minimum for suppression of impermissible emissions of flue gases constituting a public nuisance. There is a furthermore a need in heating stoves for a better method of utilization of the heating energy generated for the heating of the rooms. For the purposes of heating, a long burning time is desirable in the stove, and in order to utilize the heating energy generated by the heating stove, the air in room should circulate through the heating stove, which circulation should be able to be controlled in order to make good use of the heating energy generated.

TECHNICAL PROBLEMS

Known heating stoves of the type in question do not fulfil the requirements in respect of exhaust gas emissions which are today being made with increasing frequency, especially with respect to their installation and use in heavily built-up areas. Thus the flue gases generated are discharged from the fireplace by being allowed to rise upwards in the combustion chamber and pass through a flue pipe which is disposed above the combustion chamber, whereby the inlet of the flue pipe is disposed above the hearth. Moreover, known heating stoves can only be supplied with a limited amount of fuel and thus require frequent filling with fuel during long-term heating.

THE SOLUTION

The utilization of a procedure in accordance with the present invention fulfils, however, the requirements made and suppresses the nuisances caused by the known heating stoves. Utilization of the procedure in accordance with the invention further confers a number of other advantages, which include a safe and optimum utilization of the heating stove also as a source of heat for heating purposes. Futhermore, the heating stove can be manufactured in a simple and safe way and at low cost, the latter contributing towards a readily available source of energy for energy conservation measures and one that is also easy to install. Naturally, the heating stove also fulfils such aesthetic requirements such as increased well-being and the like. In addition, the efficiency of combustion can be utilized in a more efficient aanner and thus be better employed for the purposes of heating. The procedure in accordance with the invention is characterised in that a second duct is disposed, which communicates with the flue or exhaust pipe and leads to the fireplace of the heating stove. In order to utilize the energy from the heating stove to heat the air in the room or to achieve purification of the flue gases or exhaust gases or residues thereof during the combustion of the fuel, the front hatch of the heating stove is closed, whereby a damper is made to cover or shut off the said second duct and the said flue gases or equivalent are thereby made to pass through the hearth of the fireplace or a bed of embers achieved on the hearth and are led to the first duct for discharge of the flue gases or equivalent to the said flue.

The invention also relates to a heating stove for the implementation of the said procedure, whereby the heating stove comprises both a combustion chamber, in which a fireplace with a hearth shall be disposed, and first and second ducts, which are disposed to communicate with the combustion chamber and a flue or exhaust pipe, which is disposed or shall be disposed for discharge of the flue or exhaust gases or residues thereof from the heating stove, whereby the combustion chamber displays a bottom, lateral walls and an open side towards the front side of the heating stove, which open side can be covered by one or more front hatches. The heating stove is characterised in that the said hearth is intended to be disposed at a distance from the bottom of the combustion chamber, whereby one of the said lateral walls displays an aperture below the hearth which leads to the said first duct or to a chamber, in which one end of the said first duct opens, while the one end of the said second duct opens into the combustion chamber above the hearth and displays a damper, which is disposed to be able to cover or close the said second duct when the front hatch is closed.

BRIEF DESCRIPTION OF THE THE DRAWINGS

Figure 2:
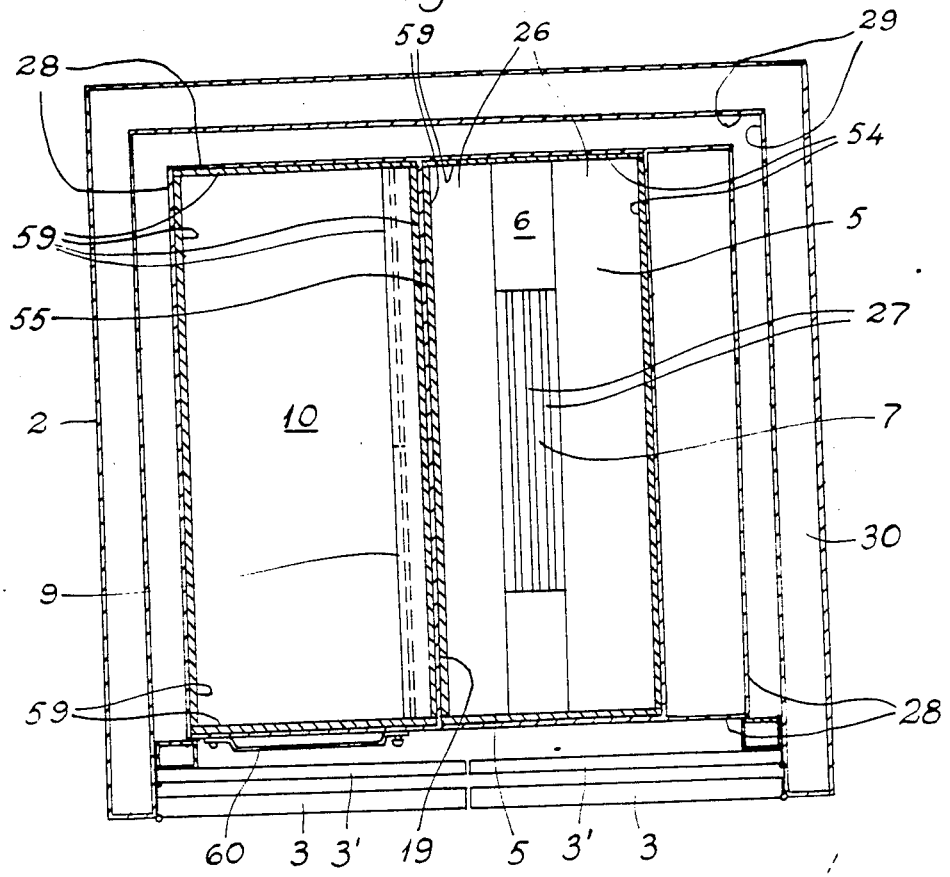
Figure 3:
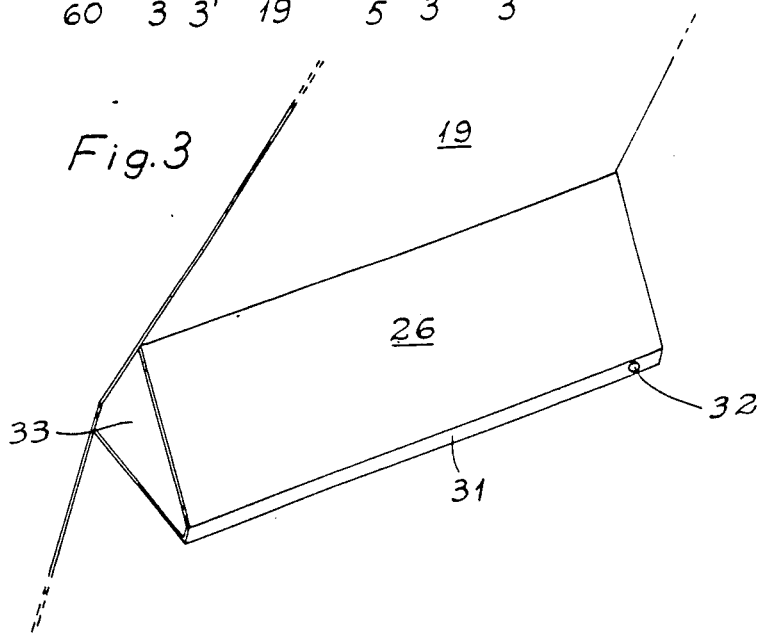
Figure 4:
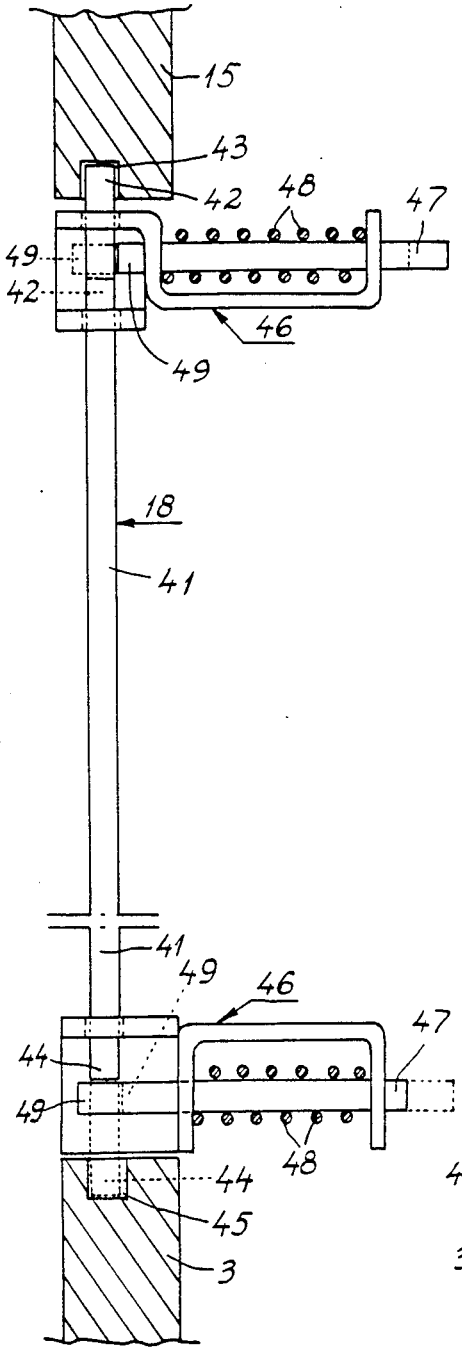
Figure 5:
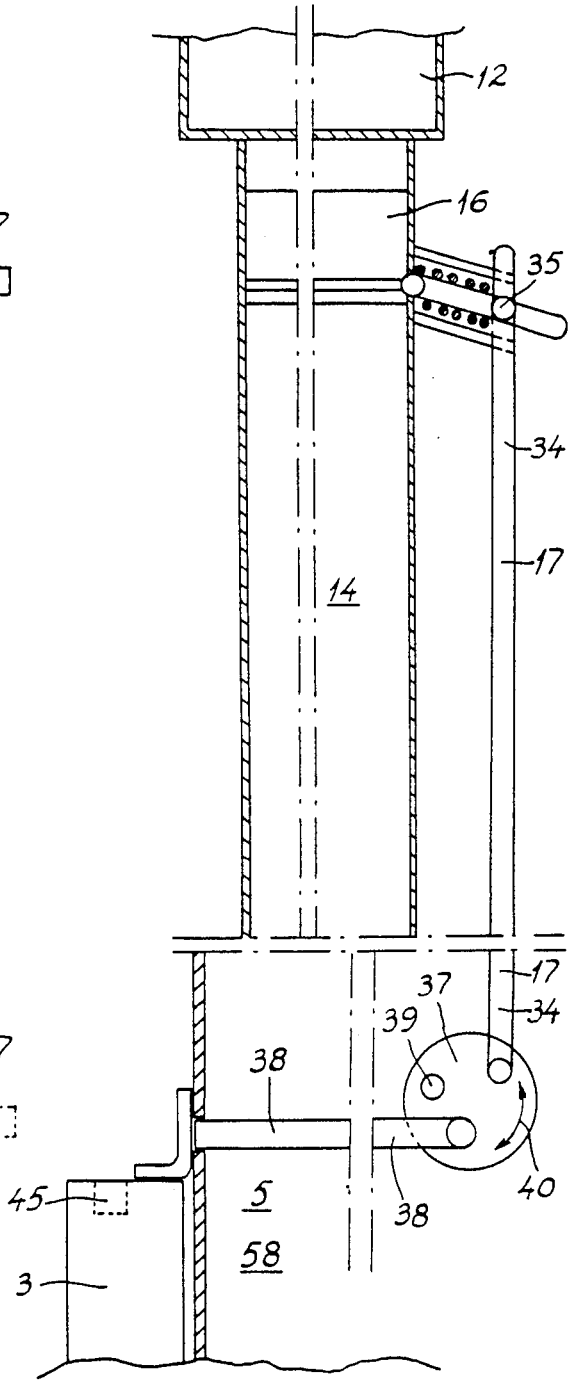
Figure 6:
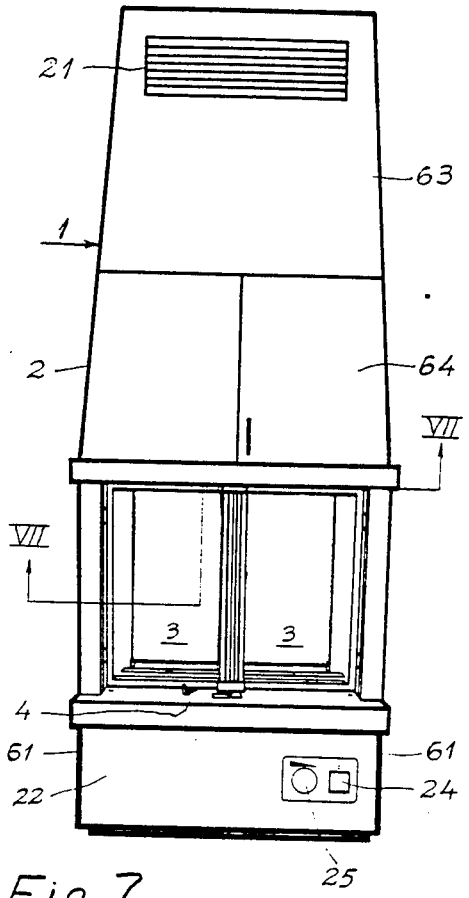
Figure 7:
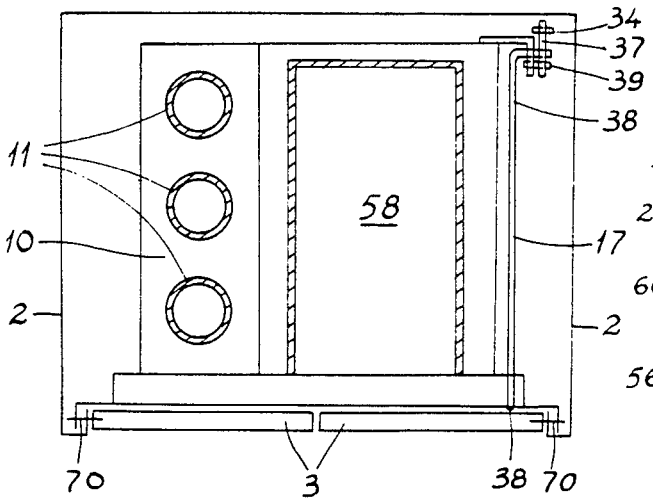
Figure 8:
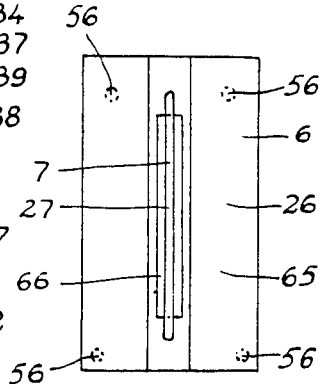
Figure 9:
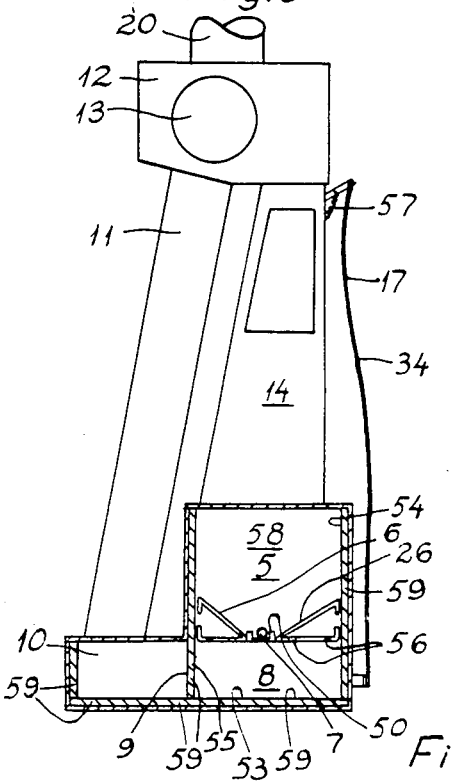
Figure 10:
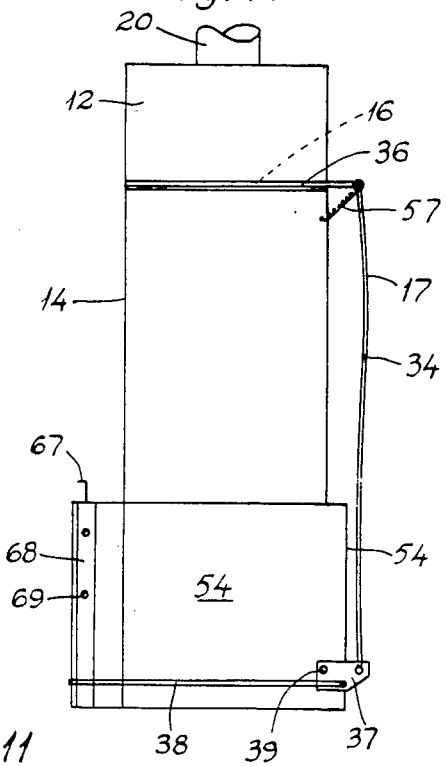
Figure 11:
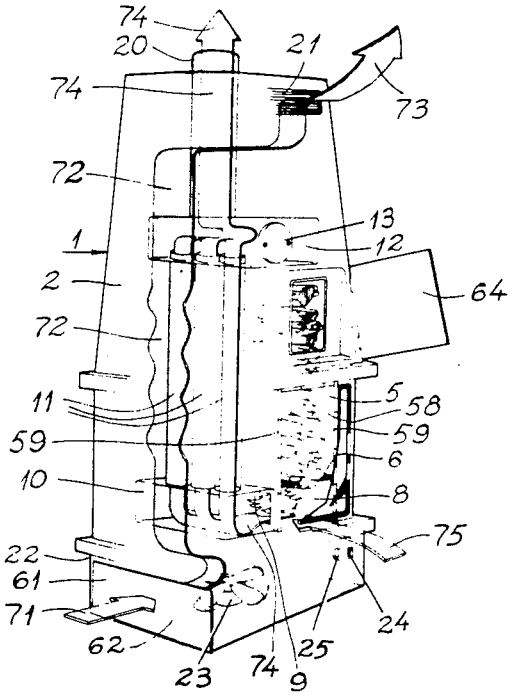

Additional characteristics of and advantages of the procedure and the heating stove in accordance with the invention will be apparent by embodiments in the descriptive text hereinafter, whereby simultaneous reference will be made to the accompanying schematic drawings, of which FIG. 1 illustrates a front view of one embodiment of a heating stove in accordance with the invention, in which parts of a front casing or outer cowling have been removed to ensure greater clarity, FIG. 2 illustrates on a larger scale a horizontal section taken along the line II—II through the stove illustrated in FIG. 1, FIG. 3 illustrates in a perspective view one part of the fireplace, FIG. 4 illustrates a catch device, FIG. 5 illustrates a regulating arrangement for a damper, FIG. 6 illustrates another example of an embodiment of a heating stove in accordance with the invention, FIG. 7 illustrates a horizontal section taken along the line VII—VII through the heating stove illustrated in FIG. 6, FIG. 8 illustrates from above a hearth, which shall be disposed in a combustion chamber, FIG. 9 illustrates from the front a heating stove without a casing, FIG. 10 illustrates from one side the heating stove illustrated in FIG. 9, and FIG. 11 illustrates in a perspective view a heating stove in accordance with the invention in an X-ray photograph, whereby components of the heating stove are apparent.

BEST MODE FOR CARRYING OUT THE INVENTION

The reference designation 1 in FIGS. 1, 6 and 11 illustrates one embodiment of heating stoves in accordance with the invention with a casing 2 or outer cowling, which on the forward or front side of the heating stove can be formed with easily removable cowling hatches 63 as well as preferably hinged casing hatches 64 for ease of access to the interior of the heating stove. In accordance with the embodiment the front side of the heating stove is provided with front hatches 3 for closing off the combustion chamber 58, whereby the front hatches 3 are provided with closing devices 4, which are provided with an opening handle, which is placed so that it is kept cool by the inward flow of the combustion air. As will be apparent from FIG. 2 the front hatches 3 can be disposed with outer and inner hatches, whereby the inner hatches 3' are formed of perforated sheet metal, which radiate the heat from the combustion chamber 58 back into the combustion chamber and which keep down the external temperature of the outer hatches The outer hatches can be formed of toughened glass. Since the combustion air is admitted at the lower front edge of the combustion chamber and below and above the front hatches, the front hatches can be kept free of soot deposits. A flue 20 leads from the heating stove and can comprise a part of the heating stove or its casing, but should comprise a communication duct from the heating stove and to the open air.

The combustion chamber 58 displays a fireplace 5 as well as a hearth 6 for the combustion of the fuel and a grate 7, which comprises a part of the support for the fuel and is provided with a grill 27, for example, in the form of one or more bars, through which ash and slag can fall down into an ash space 8, which can be provided with an ash box or ash hatch. The fireplace or hearth includes flat surfaces 26 set at an oblique angle to each other, which contribute towards the fuel, bed of embers and ash being collected in a central section of the fireplace or grate 7, i.e. that a relatively narrow, concentrated bed of embers is obtained. The glowing embers thereby produced can be better utilized for the flue gases so that the latter really do pass through the bed of embers and primarily through the hot part of the bed of embers to achieve optimum combustion of the flue gases. The obliquely set flat surfaces 26 also form upper walls for air ducts 33 for leading air to the bed of embers, see FIG. 3. The air ducts 33 are further delineated by a lower wall and a lateral wall, which can be comprised by a wall 19 in the combustion chamber 58 or the fireplace 5. The obliquely set flat surfaces 26 are formed of sheet metal plates which can be folded to form a second lateral wall 31 in the air ducts 33 and which second lateral wall 31 can be provided with one or more apertures 32, for example, in the form of through holes in the wall. By disposing one or more such apertures 32 and perhaps especially in the area far or furthest inside the fireplace 4, there is thus achieved a more even combustion of the fuel in the depth of the fireplace 5. This design of the air ducts 33 simultaneously attains a cooling of the sheet-metal material in the hearth, whereby a cooling may be desirable primarily on the obliquely set sheet-metal plates 26, which can thus obtain a longer life.

From the space 8 below the firespace 5 or the hearth 6 there is disposed a passage 9 to the flue ducts 10, 11 of the heating stove, which open into or lead to a soot box 12 with a soot hatch 13 to allow the soot box to be emptied. The part of the flue ducts located close to the fireplace can display a box shape 10, which can display an extension in the entire height and breadth of the combustion chamber, whereby large heat conduction surfaces are achieved. By this means the heat generated by the fuel and the flue gases can already be made use of in this part of the heating stove 1 and where the degree of combustion efficiency is best. The remaining part 11 of the flue ducts 10, 11 can, for the purposes of attaining large heat conduction surfaces, be comprised of several flues, for example, three pipes, which lead from the box 10 or the combustion chamber 58 and to the flue 20 or the intermediately located soot box 12.

Above the soot box 12 the casing 2 is preferably shaped with ventilation apertures, for example, in the form of a grille, which has been marked only with reference designation 21 in FIG. 1. In the casing or in a plinth 22 fitted to a heating stove 1 there can thus be disposed where required a fan 23 for circulation of air through the heating stove 1 for heating the room air in the area or building in which the heating stove 1 is located. The room air heated by the heating stove 1, its casings and flue ducts 10, 11 is emitted through the casing of the heating stove by means of the ventilation grille 21 or pipes connected to the heating stove, which can lead heated air to other areas or areas located far from the heating stove.

The ventilation grille 21 is preferably located at a high level in the heating stove 1 so that the heated air which is admitted at the bottom of the heating stove flows out at a safe, high level. The amount of warm air which is required at various times can be regulated by a thyristor 25 disposed in the heating stove, refer to the illustrated control panel, which is disposed at the front of the heating stove and which is also fitted with a main switch 24 for the fan 23. The thyristor 24 can be disposed for infinitely variable regulation of the warm air.

As will be apparent from FIG. 2, the heating stove can be fitted with double casings, i.e., both the outer cowling 2 and an insulating jacket 29, which is disposed at a distance from the outer cowling 2 and forms a duct 30 or space between the outer and inner casings, which are preferably formed on accessible parts of the heating stove and in its vertical plane. The duct 30 can be fitted with a plurality of cooling flanges. Duct 30 however lacks insulation material, whereby the lack of the mineral wool insulation usually present confers several advantages, and among them that no tufts of mineral wool whatsoever can be entrained in the air circulation through the heating stove. Moreover, it is a decisive advantage from the point of view of industrial safety that the handling of mineral wool for insulating heating stoves is dispensed with. The lower part of the heating stove and that which is located above its plinth 22 can be shaped as a box-shaped jacket 28, which at least partially can comprise said insulating jacket of the heating stove, but is preferably disposed at a distance from the insulating jacket 29, especially in respect of the area around the actual combustion chamber 58 and in particular around the flue duct 10, so that there is room for the room air to sweep past the heated heat conduction surfaces and be heated.

In accordance with a special embodiment of the heating stove in accordance with the invention, it is thus designed with automatic fuel filling and comprises a fuel store. Hence, a duct 14 extends from the combustion chamber 58 and the fireplace 5 in the vertical plane of the heating stove, whereby filling with wood, coal or briquettes can be done through a filling hatch 15. Hence, a stack of fuel can be disposed in heating stove so that it obtains a long burning time, since it gradually consumes the fuel in the fuel stack. A drying of the fuel is simultaneously achieved. In order to ensure the filling with fuel and its supply to the fireplace 5, the duct 14 can be aade somewhat sloping or with at least one sloping wall 19, whereby any risk of the fuel being wedged tight or similar is prevented. Furthermore, the sloping flat surfaces 26 ensure fuel and glowing embers to the central part of the fireplace 5 and to the bed of embers.

The casing 2 can also be comprised by a simple casing or cowling, which is disposed at a distance from a jacket, see FIGS. 7, 9 and 10. The jacket is thus comprised by the combustion chamber section, the chamber 10, the ducts 10, 11 and 14, the soot box 12, a part of a flue or exhaust pipe 20 as well as flanges 67, 68 around the front edge of the combustion chamber 58. The casing 2, likewise the front hatches 3, can be attached to said flanges by means of attachment devices 70 in hole 69.

The combustion chamber 58, the chamber 10 or the after-combustion chamber and heat exchanger in the form of the ducts 10 and/or 11 are made of sheet stainless steel.

It will be evident from FIG. 1 that the duct 14 communicates with the flue 20 and leads from the combustion chamber 58 and opens into the soot box 12. Access to the interior of the duct 14 can be obtained through the filling hatch 15. Above the filling hatch 15 there is disposed a damper 16, which by means of a damper regulating device 17 is regulatable from the outside of the heating stove, or in accordance with a special embodiment of the invention, is in communication with the front hatches 3. Moreover, there is illustrated in the figures a catch device 18 for the said filling hatch 15.

Thus the heating stove in accordance with a special embodiment is provvided with an automatically operating regulating device 17 for the damper 16. The regulating device acts in such a manner that when the front hatches 3 are open or opened, then the damper 16 opens automatically or is open, respectively, which allows a free outlet for the flue gases or equivalent to the free air through the flue 20. Such a regulating device 17 will be apparent in FIG. 5 and includes a regulating element in the form of a lengthwise extending rod 34, which via a joint 35 in its upper end gives way to a second rod 36, which is in turn articulated in the damper 16. The lengthwise extending rod 34 is fitted at its other end with an element 37, for example, in the form of a disc, which is articulated around an axle 39 or equivalent. From the element there leads a third rod 38, which protrudes beyond the casing 2 of the heating stove in order to abut the hatches 3. By means of an excentric bearing arrangement of the element 37 and the rods 34, 38, considerable regulating movements are ensured in the arrangement, whereby the element 37 moves in the directions of the arrow. The hatches 3 thus keep the said third rod 38 depressed and actuate the element 37 and the rods 34 and 36 so that the damper 16 is kept shut and closes the duct 14. It is desirable to keep the damper shut in order to obtain a natural draught through the bed of embers, where by the flue gases or equivalent pass through the hearth 6 and the bed of embers and to the flue 20 via the space 8 and the flue ducts 10, 11. When the hatches 3 are opened the lengthwise extending rod 34 will actuate the element 37 due to its own weight and cause it to rotate, whereby the damper 16 is opened and said third rod 38 protrudes further beyond the casing 2. When the hatches 3 are closed the hatches push the said third rod 38 and the element 37 moves in the opposite direction, whereby the damper 16 closes the duct 14. A further advantage of the automatic regulating device 17 is that when the front hatches 3 are opened, there is obtained an overpressure around the filling hatch 15, whereby there is no risk of flue gases coming out around the hatch. Otherwise it is necessary to rely on a good seal between the filling hatch 15 and the wall of the duct 14. When the front hatches 3 are opened, an underpressure is created at the filling hatch 15, which means that there is no risk that any flue gases will force their way out around the filling hatch. Any flues gases present are instead led up to the soot box 12 or the flue ducts and out through the flue 20.

The lengthwise extending rod 34 in the regulating device 17 can display a bent shape or several bent portions. During combustion in the heating stove 1 the jacket lengthens on account to the thermal expansion, for which reason the regulating device 17 is formed in this manner in accordance with a second embodiment, in order to achieve this automatic regulation. The lengthwise extending rod 34 hereby functions as a bending or compression spring and may also be disposed in order to close the damper against the action of an opening spring 57 disposed for the damper. The opening spring opens the damper when the front hatches 3 are opened or open. In the closure of the front hatches 3 the lengthwise entending rod 34 is made to bend further and attain tension and depresses the damper 16 against its seat. The damper 16 is thus controlled by the front hatches 3 through their opening and closing, which is an advantage for simple handling of the heating stove 1.

There is however a risk present with a utilization of a fuel store and automatic fuel filling in a heating stove, whereby there must be an opening to a duct which has direct communication with the combustion chamber. In accordance with the embodiment the opening is thus closable by a hatch at the same time as the damper 16 in the duct 14 must be disposed above the filling hatch 15. If the opening is kept open or left open and forgotten simultaneously with combustion of fuel, this can result in flue gases from the heating stove being able to flow out into the room or building in which the heating stove is located. The automatically acting regulating device 17 for the damper 16 hereby also acts so that no flue gases force their way out through the opening in the duct or around the filling hatch 15. When the front hatches 3 are open then the damper 16 is open with a free outlet via the flue for the flue gases or equivalent. When the front hatches 3 are closes the flue gases or equivalent pass through the hearth 6 and the bed of embers and on to the flue 20.

In accordance with a further special embodiment of the heating stove in accordance with the invention the heating stove can be provided with catch devices 18 for the filling hatch, which catch devices coact with the front hatches 3 so that only one of the hatches—the filling hatch 15 or the front hatches 3 respectively - can be opened at any one time. This thus prevents, for example, the front hatches 3 from being opened simultaneously as the filling hatch 15 is open, which should mean that one eliminates the risk of flue gases, soot and the like being able to gain access to a living area. A simple embodiment of such a catch device 18 is apparent in FIG. 4. The arrangement thus includes a lengthwise extending catch rod 41, whose one end 42 can be inserted to engage with the filling hatch 15, for example, through a recess 43 or a hole at the lower edge of the hatch, and its other end 44 in engagement with the front hatches 3 or one front hatch, whereby its end is inserted in, for example, a recess 45 or a hole in the front hatch. There is disposed on the casing 2 of the heating stove a fitting 46, likewise a fitting 46 on the wall of the duct 14. The fittings 46 are included in or hold catch elements, which in their simplest form consist of a pin 47, which can be displaced against the action of a spring 48. The lengthwise extending catch rod 41 should always be in engagement with one of the hatches 3, 15 and during, for example, opening of the filling hatch 15 the catch rod 41 is thus moved out of its engagement with the hatch 15 and, for example, against the action of a spring 51. The end 49 of the pin 47 has thus abutted the catch rod 41, but when the catch rod 41 is moved to one side, the pin 47 can be pushed out, its end 49 preventing the catch rod 41 from returning. Simultaneously as the catch rod 41 is moved out of engagement with the filling hatch 15, the catch rod is made to push down to engagement with the front hatch 3 so that the end 44 of the catch rod 44, which end has previously abutted the pin 47, is now inserted in the recess 45 in the front hatch. The pin 47 will thus abut the catch rod 41. In the closing and locking of the filling hatch 15 the pin 47 is moved to one side so that the catch rod 41 can spring back to engagement with the filling hatch, whereby the front hatch 3 is automatically released from the engagement of the catch rod 41 with the front hatch 3 and the pin 47 of the adjacent catch element pushes out and ensures that the catch rod 41 cannot be moved out of its engagement with the filling hatch 15.

Hence one can open the front hatches 3 during combustion of fuel without risking any leakage whatsoever of flue gases and the equivalent out into the room, since when the front hatches 3 are opened then the damper 16 is also opened. By means of the present embodiment the filling hatch 15 is closed automatically by the automatically acting catch device. Furthermore, when the filling hatch 15 is opened, the front hatches 3 are locked automatically. When the front hatches are closed, an underpressure is created in the heating stove and the flue gases, likewise the flames are led in the customary manner through the hearth and the bed of embers.

As will be apparent from FIG. 9, the hearth 6 divides the combustion chamber 58 in a fireplace section 5 and a space 8 below the hearth 6. The hearth 6 can be disposed and be removable from the combustion chamber 58 and can display a sheet-metal plate 65 with air holes 56 as well as a centrally located aperture 66 through the plate that is provided with a grate 7, which can be, like the previously described grate, lift- and/or rotatable in order to faciliate the passage of ashes accumulated on the hearth therethrough. Flanges 50 comprise stop devices for obliquely set plates 26, which rest against lateral walls 54 of the fireplace 5. The combustion chamber 58 and also the bottom and lateral walls of the box 10, or in accordance with the latter embodiments the chamber 10, can be provided with a lining 59 of, e.g., refractory bricks, whereby the wall 55 of the combustion chamber 58, below the hearth 6, i.e. in the space 8 is comprised by the lining 59, which also delineates the aperture 9 between the combustion chamber 58 or the space 8 and the duct 11 or the chamber 10 in that the lining extends only partially towards the front of the heating stove or its front hatches and leaves an aperture of, e.g., half the depth of the combustion chamber 58. The combustion chamber 58 also displays a bottom 53, which extends into the chamber 10.

The heating stove 1 can display a spark guard 60, which can be moved to one side and is joined to the heating stove and can be disposed in front of and covering a part of the fireplace 5. The dimensioning of the heating stove in accordance with the invention ensures an underpressure and a powerful draught through the bed of embers, whereby an effective combustion of the flue gases is achieved and at such high temperatures as are necessary for combustion of the flue gases.

Heating of the room air takes place in that the air is admitted through the casing, for example, through one or both sides 61 of the casing 22, which sides can be provided with dust filters 62. The air subsequently flows upwards between the combustion chamber and heat exchanger and the casing 2 and then out through the outlet 21 or an outlet aperture 21 provided with a grille. The air is conveyed by, for example, an axial fan 23, whereby the speed of the fan can be varied in an infinitely adjustable manner. The circulation of the air through the heating stove 1 will be apparent from FIG. 11, which is shown by the arrows 71 and 72.

In combustion of the fuel the front hatches 3 are kept closed, whereby the damper 16 in the duct 14, which is located as an extension upwards of the fireplace 5 or the combustion chamber 58, shuts or closes the duct 14 automatically. By this means the seat of the fire with flue gases and other exhaust gases will pass through the hearth 6 and the bed of embers achieved thereon, whereby an effective combustion and purification of the flue gases or equivalent will be obtained, especially due to the concentrated bed of embers with its consequently high temperature. The arrow 74 shows the direction of the seat of the fire and the flue gases or equivalent and their path through the heating stove 1 from the hearth 6, whereby the seat of the fire sweeps down into the space 8 below the hearth 6 and in a direction towards the aperture 9 and the chamber 10, after which the flue gases or equivalent are led up through the duct or ducts 11 and out through the flue 20. An air supply for the combustion is primarily admitted below the lower edge of the front hatches, which is shown by the arrow 75. The emission of the heated air is shown by the arrow 73.

Without exceeding the scope of the concept of the invention modifications of the heating stove in accordance with the invention should be possible. Hence it is not necessary that the heating stove be disposed for heating of air by air circulation through the heating stove, whereby neither is it necessary to have a box-shaped flue duct. In such a heating stove the autoaatic filling of fuel may naturally be utilized to advantage. The filling of fuel is in itself not necessary either in the case of a heating stove in accordance with the invention. Furthermore, the heating stove can display other component designs and dimensions and the fireplace and grate can, for example, be designed in a more customary manner. The embodiment has however illustrated a heating stove which can be disposed with the aforementioned items of equipement, which prove advantageous in specific cases. The said ducts 10, 11 can display a different shape which gives larger heat conduction areas or be provided with flanges for improved heat emission or give larger sweep areas for the circulation air.

The number of ducts can vary but they should occupy a large area. There can be several front and other hatches and they can display other designs with suitable glass, grille etc. The heating stove can also be used as an open stove, i.e. with the front hatches open or dismounted. Here the automatic damper will be open and will be kept so by the spring, for which reason there is no risk of nuisance. A further and considerable advantage of the design which the heating stove in accordance with the invention has obtained is that if use is not made of a fuel-filling duct or an equivalent duct, then there will be difficulties in lighting a heating stove of the kind in question as in the current manner it may have a resistance in the flue or a counterpressure, which however is dissolved or removed automatically in that the front hatches must be open when the heating stove is lighted, and closed as soon as possible thereafter. Fuel filling can then take place through the filling hatch or naturally through opening of the front hatches. The procedure and the heating stove are thus not restricted to what has been described and illustrated in the embodiment but solely by the claims hereinafter.

I claim:

1. A heating stove comprising a fireplace (5) having front and rear walls and a pair of opposed lateral walls (54, 55) and a hearth (6) located at an intermediate height within the fireplace and dividing the fireplace into an upper chamber above the hearth, and a space (8) below the hearth, said hearth having grate means (7) for supporting fuel while allowing combustion products to pass through the hearth; a flue (20); a first duct (11) having one end connected to the flue; means comprising aperture means (9) in one of said walls providing communication between said space (8) below the hearth and the first duct (11) for the passage of combustion products from said space (8) to the flue (20); a second duct (14) having one end connected to said flue (20) and having its other end in communication with the upper chamber; a damper (16) in the second duct; a firepalce opening in the front wall of the fireplace leading to the upper chamber above the hearth; hatch means (3) for closing the fireplace opening; linkage means (17), connected to the damper and operable by the hatch means for closing the damper when the hatch means is closed and opening the damper when the hatch means is open; and means for substantially limiting the draft through the grate to flow in the downward direction when the damper and hatch means are closed, whereby the combustion products flow from the space (8) below the grate outwardly through said aperture (9) and through the first duct (11) to the flue (20).

2. A heating stove according to claim 1 in which said damper (16) is located in the second duct (14) at a location spaced from the upper chamber, and having a fuel filling aperture in the second duct at a location between the damper and the upper chamber, and closable hatch means for closing the fuel filling aperture.

3. A heating stove in accordance with claim 26, having a soot box (12) and in which said one end of the first duct (11) is connected to the flue through the soot box (12).

4. A heating stove in accordance with claim 1, characterized in that the said first duct (11) is disposed at a distance from the said second duct (14).

5. A heating stove in accordance with claim 1, having a soot box (12) and in which said one end of the said second duct (14) is connected to the flue (20) through the soot box (12).

6. A heating stove in accordance with claim 1, characterized in that the grate (7) is centrally located in the hearth (6) and in that the hearth (6) has oblique flat surfaces (26), which slope downwardly toward the grate (7).

7. A heating stove in accordance with claim 1, characterized by air passage means for delivering a controlled air supply to a bed of embers on the hearth.

8. A heating stove in accordance with claim 1, having manually operable handle means for opening and shutting the front hatch (3), and air passage means for admitting a supply air to the fireplace for combustion of the fuel, said air passage means having an outer opening adjacent to the handle means (4) whereby the handle means (4) are kept cool by the admitted air.

9. A heating stove in accordance with claim 1, characterized in that the means for closing and opening the damper (16) includes a spring (57) connected to the damper and disposed to keep the damper in an open position when the hatch means (3) is open.

10. A heating stove in accordance with claim 1, characterized in that the linkage means (17) includes a rod (34) having a bent shape, whereby the rod is able to be spring-tensioned when the hatch means (3) is closed, so that the spring tension in the rod maintains a closing force on the damper during thermal expansion of the stove.

11. A heating stove in accordance with claim 1, characterized in that the fireplace (5) is provided with a lining (59) of refractory bricks and in that said aperture means (9) is an opening in said lining.

12. A heating stove in accordance with claim 1, having a caseing (2) containing said first and second duct and space from at least said first duct, and characterized in that there is disposed below the fireplace a fan (23) for admission of room air into the casing (2) and subsequent return of the air from the casing into the room.

13. Heating stove in accordance with claim 12, characterized in that the regulating element (34) during the occupation of a tension position shuts or closes the damper (16) against the action of a spring force in a spring (57), which is disposed as an opening element for the damper.

14. Heating stove in accordance with claim 5, characterized in that the front hatch (3) and the filling hatch (15) are disposed in connection with each other by means of a catch device (18), which is disposed to block the front hatch or the filling hatch against opening, whereby when the catch device is disposed in engagement with the front hatch (3) the front hatch is unopenable, while the filling hatch (15) is openable and when the catch device (18) is disposed in engagement with the filling hatch (15) the filling hatch is unopenable, while the front hatch (3) is openable.

15. Heating stove in accordance with claim 5, characterized in that the combustion chamber (58) and preferably also the chamber (10) or its lateral walls and bottom are provided with a lining (59) of, for example, refractory bricks.

16. Heating stove in accordance with claim 5 or 15, characterized in that one lateral wall (55) of the combustion chamber (58) below the hearth (6) is comprised by a lining (59) in the combustion chamber and delineates the width of the said aperture (9).

17. Heating stove in accordance with claim 5, characterized in that there is disposed below the combustion chamber (58) a fan (23) for admission and circulation of room air behind a casing (2) displaying the heating stove (1) and subsequent emission of the air through the casing.

18. Heating stove in accordance with claim 10, characterized in that the grate (7) is disposed lift- and/or rotatable in order to facilitate for ash accumulated on the hearth (6) to pass through the hearth.

* * * * *